US005435148A

United States Patent [19]

Sandofsky et al.

[11] Patent Number: 5,435,148

[45] Date of Patent: Jul. 25, 1995

[54] APPARATUS FOR MAXIMIZING AIR CONDITIONING AND/OR REFRIGERATION SYSTEM EFFICIENCY

[75] Inventors: Marc D. Sandofsky, Natick; David F. Ward, Framingham, both of Mass.

[73] Assignee: JDM, Ltd., Marlborough, Mass.

[21] Appl. No.: 127,976

[22] Filed: Sep. 28, 1993

[51] Int. Cl.[6] ..... F25B 41/00

[52] U.S. Cl. ..... 62/197; 62/DIG. 17; 62/DIG. 2

[58] Field of Search ..... 62/DIG. 2, 513, DIG. 17, 62/527, 197, 498

[56] References Cited

U.S. PATENT DOCUMENTS

| | | | |
|---|---|---|---|
| 1,946,328 | 2/1934 | Neff | 62/DIG. 2 |
| 2,949,750 | 8/1960 | Kramer | 62/DIG. 2 |
| 3,081,606 | 3/1963 | Brose et al. | 62/DIG. 2 |
| 4,136,528 | 1/1979 | Vogel et al. | 62/DIG. 17 |
| 4,599,873 | 7/1986 | Hyde | 62/DIG. 2 |

FOREIGN PATENT DOCUMENTS

| | | | |
|---|---|---|---|
| 4116344 | 4/1992 | Japan | 62/DIG. 2 |

*Primary Examiner*—William E. Wayner

*Attorney, Agent, or Firm*—Gerry A. Blodgett; Blodgett & Blodgett

[57] ABSTRACT

A compression-type refrigeration system is disclosed, in which "flash gas" formation is eliminated without artificially maintaining condenser temperature and pressure levels. Condenser temperatures and pressures are allowed to fluctuate with ambient operating conditions, resulting in reduced compressor load and increased refrigeration capacity. After condensation, liquified refrigerant in the conduit between the receiver and the expansion valve is pressurized without adding heat, by means of a combination of (a) a positive-displacement pump, in parallel with the conduit, (b) a bypass conduit pressure regulating controller, and (c) a check valve in the conduit, to a pressure sufficient to suppress flash gas in the conduit. A variable speed liquid injection pump is provided to inject liquid refrigerant from downstream of the positive-displacement pump to upstream of the condenser, at a controlled rate sufficient to desuperheat the refrigerant upstream of the condenser.

4 Claims, 7 Drawing Sheets

APPARATUS FOR MAXIMIZING AIR CONDITIONING AND/OR REFRIGERATION SYSTEM EFFICIENCY

FIELD OF THE INVENTION

This invention generally relates to the field of mechanical refrigeration and air conditioning and more particularly to improving efficiency of compression-type refrigeration and air conditioning systems.

BACKGROUND OF THE INVENTION

In the operation of commercial freezers, refrigerators, air conditioners and other compression-type refrigeration systems, it is desirable to maximize refrigeration capacity while minimizing total energy consumption. Specifically, it is necessary to operate the systems at as low a compression ratio as possible without the loss of capacity that normally occurs when compressor compression ratios are reduced. This is accomplished by suppressing the formation of flash gas. Flash gas is the spontaneous flashing or boiling of liquid refrigerant resulting from pressure losses in refrigeration system liquid refrigerant lines. Various techniques have been developed to eliminate flash gas. However, conventional methods for suppressing flash gas can substantially reduce system efficiency by increasing energy consumption.

FIG. 1 represents a conventional mechanical refrigeration system of the type typically used in a supermarket freezer. Specifically, compressor 10 compresses refrigerant vapor and discharges it through line 20 into condenser 11. Condenser 11 condenses the refrigerant vapors to the liquid state aided by circulating fan 31. The liquid refrigerant next flows through lines 21*a* and 21*b* into receiver 12. From receiver 12, the liquid refrigerant flows through line 22 to counter-flow heat exchanger (not shown). After passing through the exchanger, the refrigerant flows via line 23 through thermostatic expansion valve 14. Valve 14 expands the liquid refrigerant to a lower pressure liquid which flows into and through evaporator 15 where it evaporates back into a vapor, absorbing heat. Valve 14 is connected to bulb 16 by capillary tube 30. Bulb 16 throttles valve 14 to regulate temperatures produced in evaporator 15 by the flow of the refrigerant. Passing through evaporator 15, the expanded refrigerant absorbs heat returning to the vapor state aided by circulating fan 32. The refrigerant vapor then returns to compressor 10 through line 24.

In order to keep the refrigerant in a liquid state in the liquid line, the refrigerant pressure is typically maintained at a high level by keeping the refrigerant temperature at condenser 11 at a minimum of approximately 95° F. This minimum condensing temperature maintains pressure levels in receiver 12 and thus the liquid lines 22 and 23 above the flash or boiling point of the refrigerant. At 95° F. this pressure for example would be; 125 PSI for R12 refrigerant, 185 PSI for R22 refrigerant and 185 PSI for R502 refrigerant. These temperature and pressure levels are sufficient to suppress flash gas formation in lines 22 and 23 but the conventional means of maintaining such levels by use of high compressor discharge pressures limit system efficiency.

Various means are used to maintain the temperature and pressure levels stated above. For example, FIG. 1 shows a fan unit 31 connected to sensor 17 in line 21. Controlled by sensor 17, fan unit 31 is responsive to condenser temperature or pressure and cycles on and off to regulate condenser heat dissipation. A pressure responsive bypass valve 18 in condenser output line 21 is also used to maintain pressure levels in receiver 12. Normally, valve 18 is set to enable a free flow of refrigerant from line 21*a* into line 21*b*. When the pressure at the output line of condenser 11 drops below a predetermined minimum, valve 18 operates to permit compressed refrigerant vapors from line 20 to flow through bypass line 20*a* into line 21. The addition to vapor from line 20 into line 21 increases the pressure in receiver 12, line 22 and line 23, thereby suppressing flash gas.

The foregoing system eliminates flash gas, but is energy inefficient. First, maintaining a 95° condenser temperature limits compressor capacity and increases energy consumption. Although the 95° F. temperature level maintains sufficient pressure to avoid flash gas, the resultant elevated pressure in the system produces a back pressure in the condenser which increases compressor work load. The operation of bypass valve 18 also increases back pressure in the condenser. In addition, the release of hot, compressed vapor from line 20 into line 21 by valve 18 increases the refrigerant specific heat in the receiver. The added heat necessitates yet a higher pressure to control flash gas formation and reduces the cooling capacity of the refrigerant, both of which reduce efficiency.

Another approach to suppressing flash gas has been to cool the liquid refrigerant to a temperature substantially below its boiling point. As shown in FIG. 1, a subcooler unit 40 has been used in line 22 for this purpose. However, subcooler units require additional machinery and power, increasing equipment and operating cost and reducing overall operating efficiency.

Other methods for controlling the operation of refrigeration systems are disclosed in U.S. Pat. Nos. 3,742,726 to English, 4,068,494 to Kramer, 3,589,140 to Osborne and 3,988,904 to Ross. For example, Ross discloses the use of an extra compressor to increase the pressure of gaseous refrigerant in the system. The high pressure gaseous refrigerant is then used to force liquid refrigerant through various parts of the system. However, each of these systems is complex and requires extensive purchases of new equipment to retrofit existing system. The expenses involved in the purchase and operation of these methods usually outweigh the savings in power costs.

A more recent method of controlling the formation of flash gas in the liquid line was disclosed in U.S. Pat. No. 4,599,873 by R. Hyde. This method involves the use of a magnetically coupled centrifugal pump placed in the liquid line as seen in FIG. 2. FIG. 2 shows a vapor line 114, a condenser 116, a fan unit 118, a liquid line 120, a receiver 122, a pump 124 and 125, a liquid line 126, a heat exchanger 128, a liquid line 129, a valve 130, a line 131, a control 132, an evaporator 134, a fan unit 138, and a vapor line 144. The purpose of this method is to improve system efficiency by allowing system condensing pressures and temperatures to be reduced as ambient temperatures reduce. The centrifugal pump 124 adds pressure to the liquid line 126 at the point where the liquid line exits from the condenser 122 or receiver without the use of compressor horsepower. This method of using a centrifugal pump to add pressure reduces the amount of flash gas that forms in the liquid line, but does not eliminate it altogether.

Furthermore, examination of the centrifugal pump curve in FIG. 3 shows that as flow increases, the pressure added by the centrifugal pump decreases. However, as flow of refrigerant liquid through the liquid line increases the pressure drop in the liquid line increases by the square of the velocity. This combination of effects as shown in FIG. 4, causes the centrifugal pump to only reduce the formation of flash gas during certain low flow conditions, below point A in FIG. 4. As refrigerant flow increases at high load conditions and the pressure added by the centrifugal pump decreases, the formation of flash gas begins to increase again and system capacity is lost when it is needed most.

Another deficiency of the previously described centrifugal pumping method is that the centrifugal pump is located within the liquid line itself. If the centrifugal pump fails to operate properly for any reason, it becomes an obstruction to flow of refrigerant liquid seriously impairing the operation of the refrigeration system.

The most serious deficiency of the previously described centrifugal pumping method is caused by the state of the refrigerant at the outlet of the condenser 116 or receiver 122. The liquid refrigerant at this location in the system is commonly at or very near the saturation point. Any vapor that forms at the inlet of the centrifugal pump due to incomplete condensation or slight drop in pressure caused by the pump suction or any other reason will cause the centrifugal pump to cavitate or vapor lock and lose prime. This renders the centrifugal pump ineffective until the system is stopped and restarted again, and is very detrimental to pump life and reliability. Due to the constantly varying conditions of operation of the refrigeration system this can occur with great regularity.

A further development pertaining the fields of mechanical air conditioning and refrigeration relating to system optimization is disclosed by U.S. Pat. No. 5,150,580 also by R. Hyde. This development, seen in FIG. 2, involves the transfer of some small amount of liquid refrigerant from the outlet of the centrifugal pump 124 in the liquid line 126 to be injected via conduit 136 into the compressor discharge line 114 by means of the added pressure of the centrifugal pump 124 in the liquid line. The purpose of injection this liquid into the discharge line is to desuperheat the compressor discharge vapors before they reach the condenser to reduce condenser pressure and thereby reduce the compressor discharge pressure. This development is said to improve system efficiency at high ambient temperatures when air conditioning systems work the hardest and system pressures are the highest.

Again, however, as system pressures increase and refrigerant flow rates increase at higher loads, the increased flow rate of refrigerant causes more pressure loss through the condenser. However, this same increased flow rate causes less pressure to be added to the liquid by the centrifugal pump 124 in the liquid line 126. Thus, less liquid is bypassed via conduit 136 into the compressor discharge line and less superheat is eliminated at the time when more reduction is needed. And at some point the pressure loss through the condenser is greater than the pressure added by the centrifugal pump and the effect is lost entirely.

Obviously, there remains a need to provide a stable pressure increase in the liquid line 126 to completely eliminate the formation of flash gas, and likewise a stable pressure increase in the liquid injection line 136 to completely desuperheat the compressor discharge vapors if the improvement in system efficiency is to be realized on a constant and reliable basis regardless of system configuration or refrigerant flow rate or vapor content.

The objectives of the present invention are to:

1) Reliably and constantly increase the pressure in the liquid line to suppress the formation of flash gas without unnecessarily maintaining a high system pressure, and without the possibility of obstructing the flow of refrigerant through the liquid lien.

2) To reliably and constantly inject the correct amount of liquid into the compressor discharge line to maximize the heat transfer in the condenser.

3). To improve the operating efficiency of compression-type refrigeration and air conditioning systems in a constant, controlled and reliable basis regardless of system configuration or refrigerant flow rate.

4). To maximize the refrigeration capacity of refrigeration and air conditioning systems in a constant, controlled and reliable basis regardless of system configuration or refrigerant flow rate.

5). To economically and constantly suppress the formation of flash gas in refrigeration and air conditioning systems without impairing refrigeration capacity and efficiency regardless of system configuration or refrigerant flow rate.

6). To provide a way to inexpensively retrofit existing refrigeration systems to attain the foregoing objects on a reliable and controllable basis regardless of the system configuration or refrigerant flow rate.

7). Further, the previous objects must be met in a way that will not be detrimental to the system in the event of failure of the installed pumping mechanism.

8). Still further, the above objects must be reliably met regardless of the presence of some vapor in the liquid at the inlet of the pumping arrangement since the liquid is at or near saturation.

9). Moreover, the above objects must be met in a way that can be adjusted to satisfy a majority of the wide range of system configurations found in the field.

This invention provides for the refrigeration or air conditioning system to be operated in a way which maximizes energy efficiency and suppresses flash gas formation regardless of system configuration or refrigerant flow rate.

The foregoing and other objects, features, and advantages of the invention will become more readily apparent from the following description of a preferred embodiment, which proceeds with reference to the figures.

SUMMARY OF THE INVENTION

The invention entails the use of a positive displacement pump magnetically coupled to a drive motor located in a conduit arrangement that is parallel to the liquid line of the refrigeration system as in FIG. 6. This parallel conduit arrangement also includes a pressure regulating valve that will regulate the amount of pressure added to the liquid line by the parallel pump and piping arrangement. In addition, a check valve is located in the liquid line to maintain the pressure differential added to the liquid line. This parallel piping arrangement is desirable in order to allow a constant, pre-determined pressure to be added to the liquid line regardless of variations in flow rate of the liquid refrigerant. In addition, the parallel piping arrangement allows the system to operate without liquid line obstruction in the event of pump failure.

Further, a pump is added to the liquid injection line that is connected between the liquid line and the compressor discharge line for the purpose of desuperheating the compressor discharge vapors. This pump insures a constant flow of liquid refrigerant to the compressor discharge line to fully desuperheat the compressor discharge vapors. The preferred method would entail the use of a positive displacement pump, but any suitable pumping method can be used.

Also, the above pump can be controlled by a variable speed drive mechanism. The variable speed drive mechanism is controlled by two (2) temperature sensors. One temperature sensor is located on the condenser to sense saturated temperature of the refrigerant in the condenser. The other temperature sensor is located at the inlet of the condenser downstream of the point of liquid injection into the compressor discharge line to sense amount of superheat in the discharge line. The speed of the pump located in the liquid injection line is varied by the attached variable speed drive by means of the sensed temperature diferential to provide just the proper amount of liquid injection into the discharge line to adequately desuperheat the compressor discharge vapors for optimum heat transfer in the condenser regardless of the refrigerant flow rate or amount of superheat present in the compressor discharge vapors.

DETAILED DESCRIPTION OF THE PREFERRED EMBODIMENT

Figure 1:
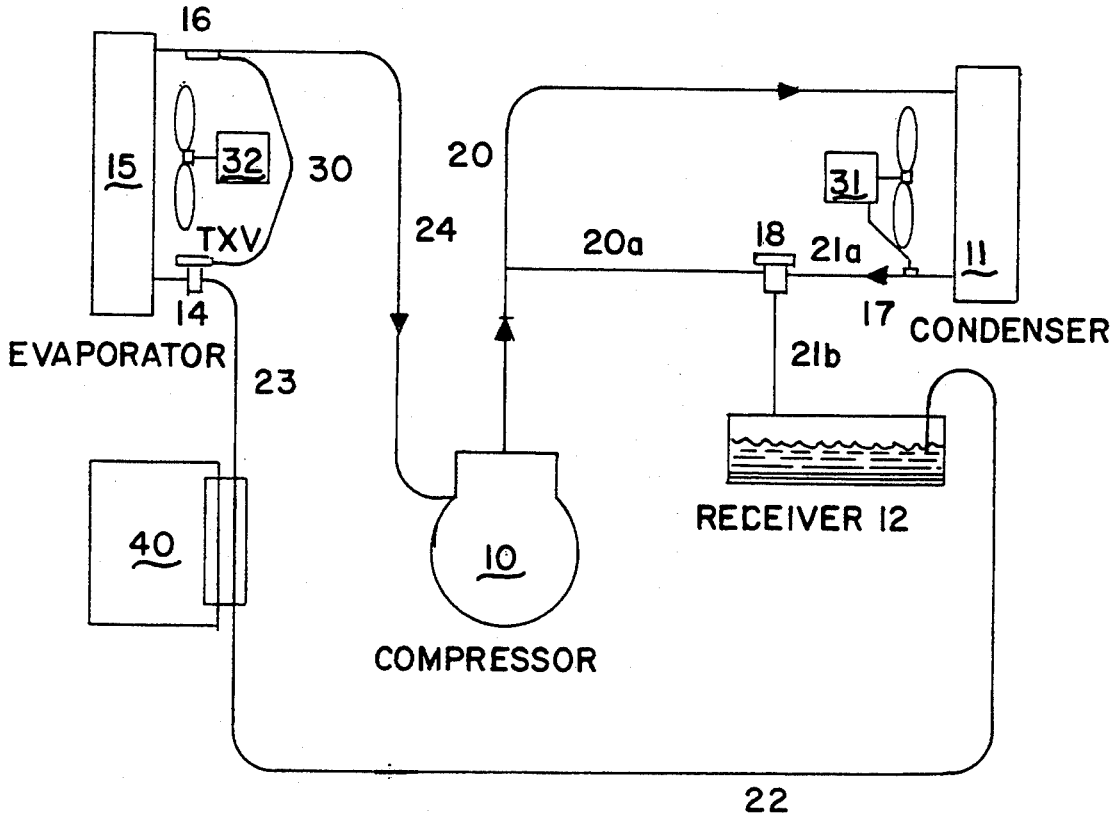
Fig. 1 (PRIOR ART)
FIG. 1 is a schematic diagram of a typical refrigeration system, as previously described.
Figure 2:
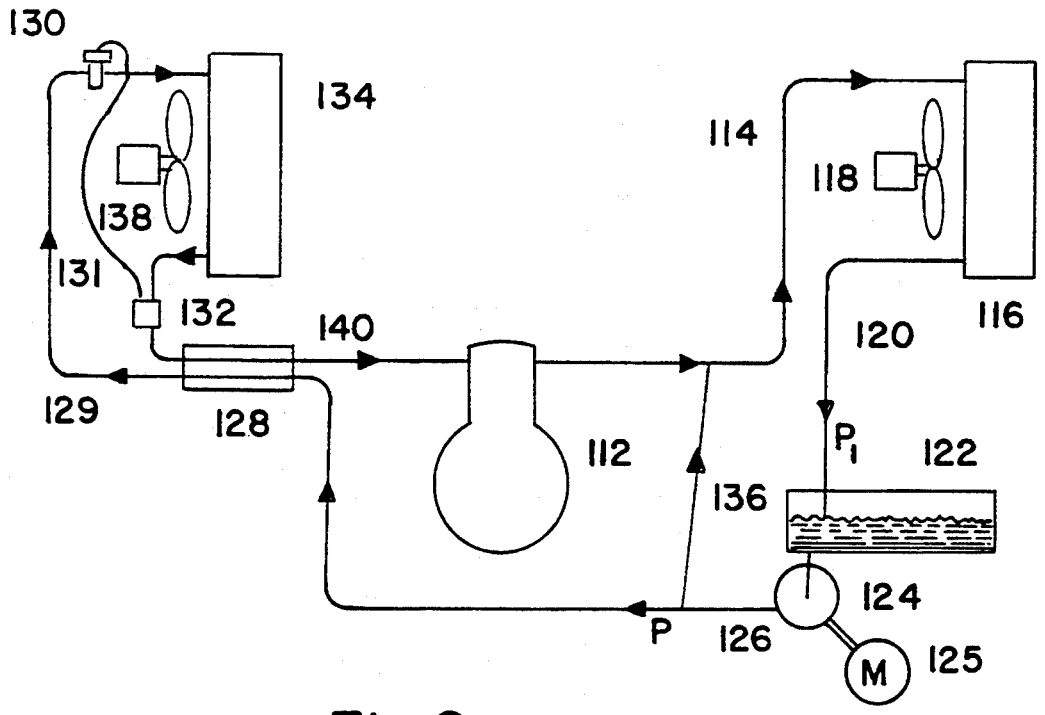
Fig. 2 (PRIOR ART)
FIG.2 is a schematic diagram of a refrigeration system including the prior art as previously described including the liquid injection for desuperheating.
Figure 3:
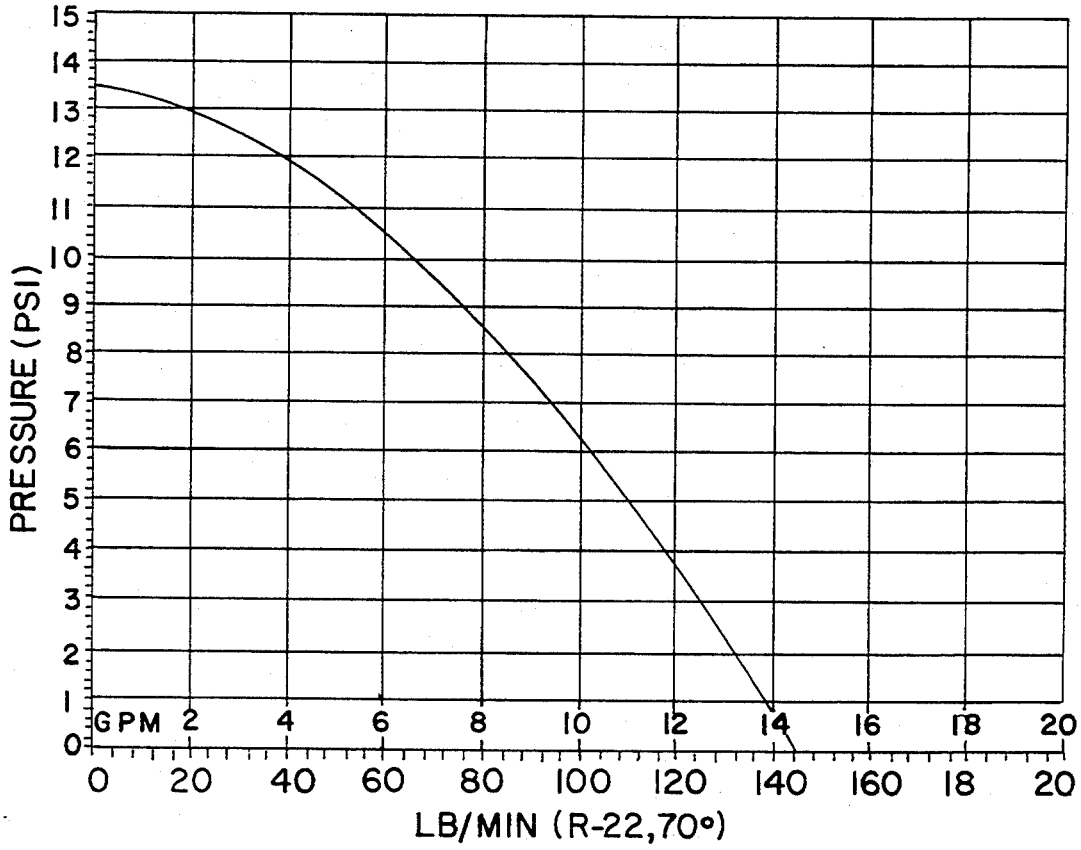
FIG. 3 is a diagram of a typical centrifugal pump curve showing pressure added vs. flow rate.
Figure 4:
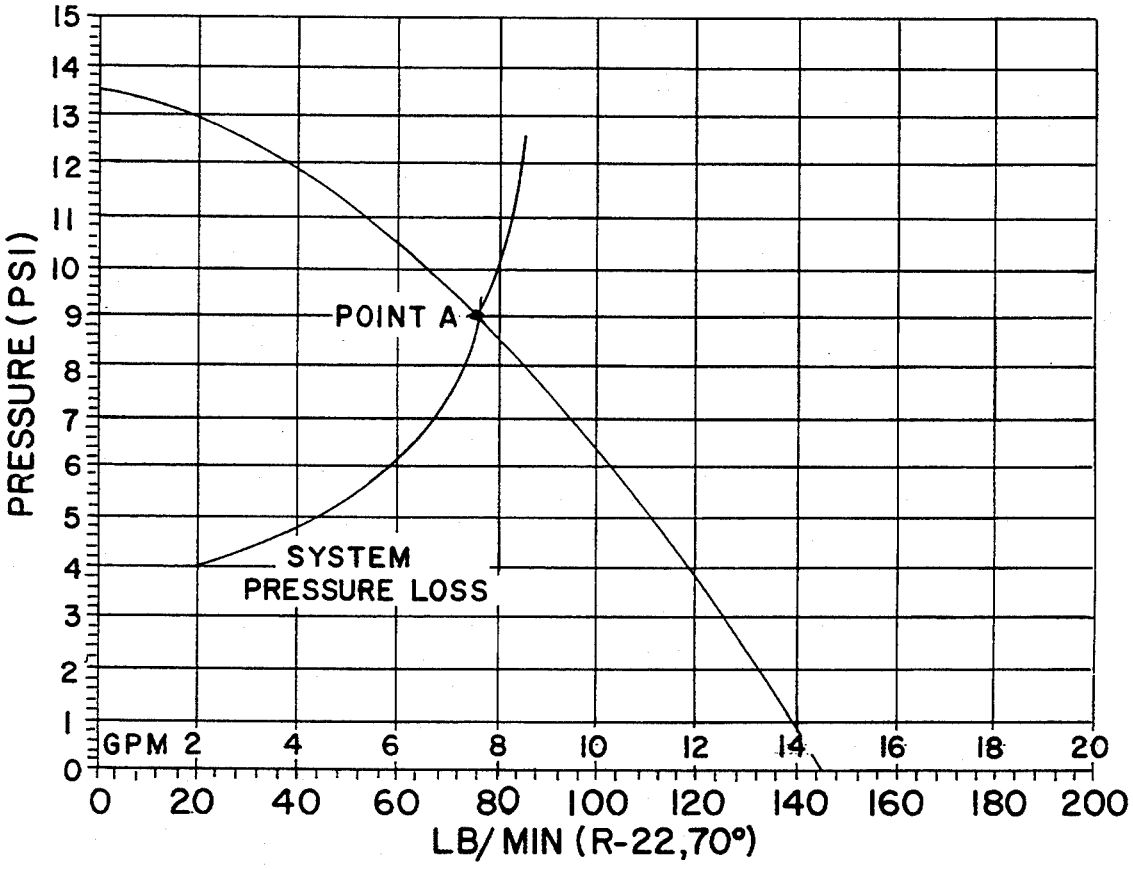
FIG. 4 is a diagram of pressure loss through a piping system vs. flow rate with the centrifugal pump curve superimposed over it.
Figure 5:
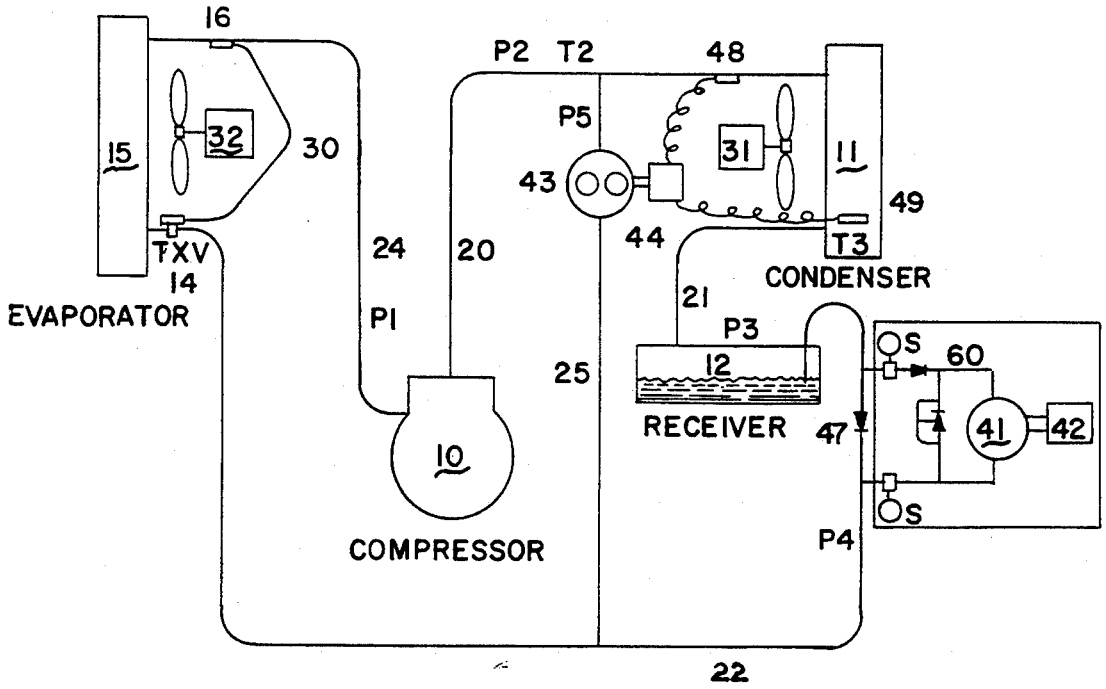
FIG. 5 is a schematic diagram of a refrigeration system including the present invention.

Referring now to FIG. 5, a closed circuit compression-type refrigeration system includes a compressor 10, a condenser 11, an optional receiver 12, an expansion valve 14 and an evaporator 15 connected in series by conduits defining a closed-loop refrigerant circuit. Refrigerant gas is compressed by compressor unit 10, and routed through discharge line 20 into condenser 11. A fan 31 facilitates heat dissipation from condenser 11. Another fan 32 aids evaporation of the liquid refrigerant in evaporator 15. The compressor 10 receives warm refrigerant vapor at pressure P1 and compresses and raises its pressure to a higher pressure P2. The condenser cools the compressed refrigerant gases and condenses the gases to a liquid at a reduced pressure P3. From condenser 11, the liquefied refrigerant flows through line 21 into receiver 12 in cases where there is currently a receiver in the system. If there is no receiver in the system the condensed refrigerant flows directly into the liquid line 22. Receiver 12 in turn discharges liquid refrigerant into liquid line 22.

Figure 6:
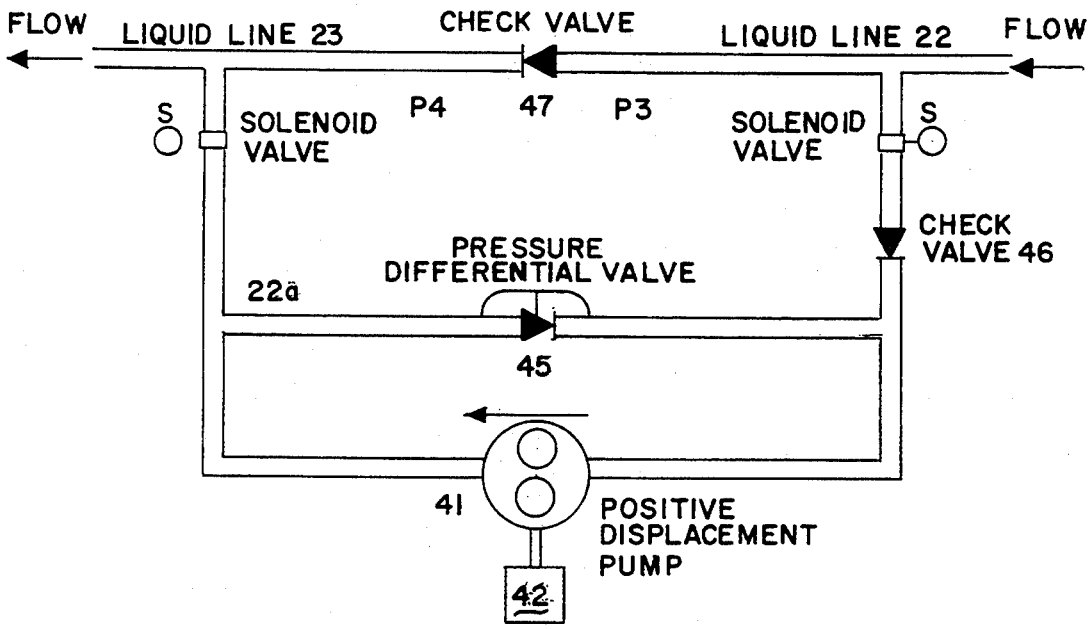
FIG. 6 is a more detailed diagram of the parallel piping arrangement with positive displacement pump, pressure differential regulating valve and check valves of the present invention.

A positive displacement pump 41, driven by electric motor 42 (see FIG. 6) magnetically coupled to the pump head is positioned in conduit arrangement 60 parallel to the liquid line 22 at the outlet of the receiver or condenser to pressurize the liquid refrigerant in line 23 to an increased pressure P4. This parallel piping arrangement 60 also includes the pressure differential regulating valve 45 (FIG. 6) and a check valve 46 arranged as shown in FIG. 6 to provide for a constant added pressure (P4—P3) regardless of refrigerant flow rate or vapor content. A check valve 47 is added to the liquid line 22 to maintain the pressure differential between line 22 and line 23 (See FIG. 7). An adjustable pressure regulating valve 45 (FIG. 6) can also be used to more accurately match the pressure differential required or to facilitate changes that may be needed in the pressure differential added. The pressure differential of the regulating valve 45 determines the amount of pressure that is added to the system. Different amounts of pressure can be added to the liquid line 22 as necessary for each different system configuration by using different pressure differential valves or by adjusting the valve to a specific pressure as needed. As the flow rate of the system varies in conduit 22, more or less refrigerant flows through parallel conduit **22*a* (FIG. 6) and pressure regulating valve 45 so the refrigerant flow into and out of the parallel piping arrangement 60 always matches the flow rate through conduit 22 and 23** and the pressure differential (P4—P3) remains constant.

Figure 7:
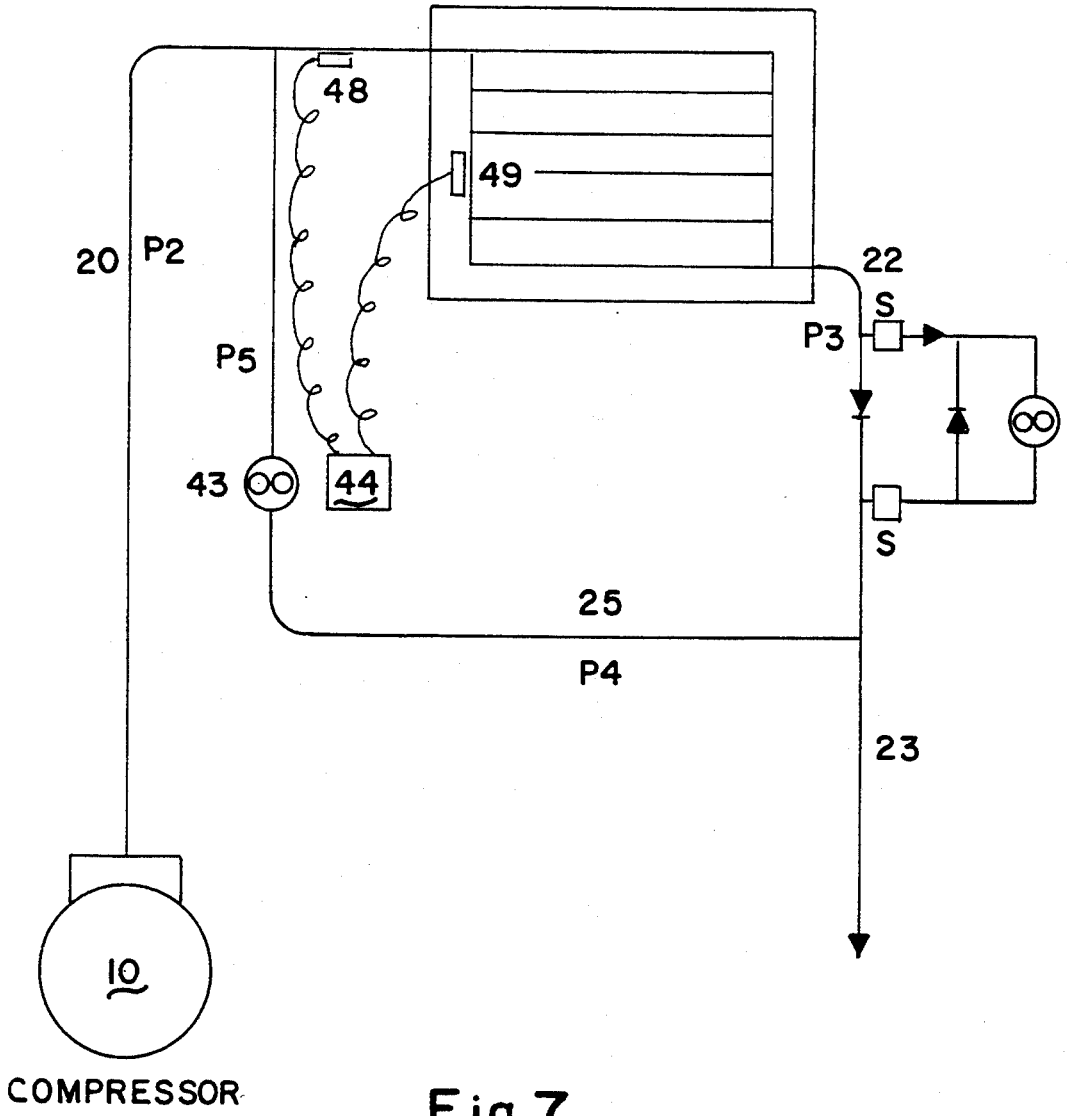
FIG. 7 is a more detailed diagram of the preferred method of adding pressure to the liquid injection line including the optional preferred control method.

From parallel piping arrangement 60 the liquid refrigerant flows into the liquid line 23 (FIG. 7). Some of the liquid refrigerant flows through conduit 25 and through pump 43 into compressor discharge line 20 to desuperheat the compressor discharge vapor. Preferrably pump 43 would be a positive displacement pump controlled by variable speed drive 44. The speed of the pump is determined by the temperature differential between the condensing temperature of the refrigerant in condenser 11 as sensed by bulb 49 and the temperature of the superheated refrigerant in line 20 as sensed by bulb 48.

The remainder of the liquid refrigerant from the parallel piping arrangement 60 flows through the line and through an optional counter-current heat exchanger (not shown) to thermostatic expansion valve 14. Thermostatic expansion valve 14 expands the liquid refrigerant into evaporator 15 and reduces the refrigerant pressure to near P1. Refrigerant flow through valve 14 is controlled by temperature sensing bulb 16 positioned in line 24 at the output of evaporator 15. A capillary tube 30 connects sensing bulb 16 to valve 14 to control the rate of refrigerant flow through valve 14 to match the load at the evaporator 15. The expanded refrigerant passes through evaporator 15 which, aided by fan 32, absorbs heat from the area being cooled. The expanded, warmed vapor is returned at pressure P1 through line 24 to compressor 10, and the cycle is repeated.

Pump 41 and pressure regulating piping arrangement 60 is preferably located as close to receiver 12 or the outlet of condenser 11 as possible, and may be easily installed in existing systems without extensive purchases of new equipment. Pump 41 must be of sufficient capacity to increase liquid refrigerant pressure P3 by whatever pressure is necessary to eliminate the formation of flash gas in the liquid line 23 (FIG. 6). Pump 41 must be capable of adding a constant pressure to the liquid line under conditions of variable refrigerant discharge rates from valve 14, including conditions in which valve 14 is closed. The pump must also be capable of adding a constant pressure to the liquid line regardless of the presence of some vapor in the incoming liquid refrigerant in line 22. A positive displacement pump and pressure regulating valve located in a parallel piping arrangement 60 most effectively, economically and reliably provides this capability.

OPERATION

Referring to FIG. 5, compressor 10 compresses the refrigerant vapor which then passes through discharge line 20 to condenser 11. In the condenser 11, at pressure P2, heat is removed and the vapor is liquefied by use of ambient air or water flow across the heat exchanger. At condenser 11, temperature and pressure levels are allowed to fluctuate with ambient air temperatures in an air-cooled system, or with water temperatures in a water-cooled system to a minimum condensing pressure/-temperature that has previously been set at about 95° F. This previously set minimum condensing temperature has been necessary to prevent the formation of flash gas in the liquid line 22. The previously set minimum was maintained by reducing air or water flow across the heat exchanger of condenser 11 to reduce heat transfer from the condenser. Further decreasing the condensing temperatures increase system efficiency in two ways: 1) The lower pressure differential of the compressor 10 increases the compressor volumetric efficiency according to the formula $V_e=1+C-C^*(V_1/V_2)$ where $V_e$ is volumetric efficiency, C is the clearance ratio of the compressor, $V_1$ is the specific volume of the refrigerant vapor at the begining of compression, $V_2$ is the specific volume of the refrigerant vapor at the end of compression, and 2) The lower liquid refrigerant temperature at the outlet of the condenser results in a greater cooling effect in the evaporator.

The negative effect of reducing condensing temperatures below this previously set minimum has been the formation of flash gas in the liquid line 23 (FIG. 7), which when passed through expansion valve 14 reduced the net refrigeration effect of the evaporator 15. The net result was a reduction of energy consumption per unit time by the compressor, but a simultaneous reduction capacity of the system causing an increase in compressor run time resulting in no net energy savings.

When the refrigeration or air conditioning system is modified with the present invention as in FIG. 6, the minimum condensing temperature and pressure can be reduced significantly without the loss of capacity mentioned above due to the pressure added to the liquid line by the pump 41 and parallel piping arrangement. As the ambient air temperature or water temperature used to cool the condenser becomes lower, the efficiency of the compressor improves, and the capacity of the evaporator increases since no flash gas has been allowed to form in the liquid line. This is most beneficial with refrigeration systems that operate year around and can take advantage of the cooler ambient temperatures.

As ambient air temperature or cooling water temperature increases, the condensing temperature and pressure of the refrigeration or air conditioning system also increases and efficiency is reduced. In order to improve eficiency at these higher ambient conditions when air conditioning and refrigeration systems are at or near maximum capacity, liquid refrigerant is bypassed from the liquid line (FIG. 5) into the compressor discharge line 20. Since there is some amount of pressure lost as the refrigerant passes through the condenser, making condenser exit pressure P3 lower than entrance pressure P2, a pump is needed to add enough pressure to insure flow of liquid from the liquid line into the discharge line 20. The preferred method is to use a positive displacement pump, driven by a variable speed drive, controlled by the temperature differential between the superheated compressor discharge vapor temperature T2 and the condensing temperature T3. As the temperature differential becomes greater, the variable speed drive would cause the positive displacement pump to pump more liquid into the discharge line 20 to decrease the superheat. When the superheat temperature and the condensing temperature were the same, the refrigerant vapor entering the condenser would be at the saturation point and the speed of the positive displacement pump would stabilize to a pre-set speed to maintain the condition.

This method of superheat suppression insures that the refrigerant vapor is entering the condenser at saturation resulting in the optimum conditions for heat transfer thereby optimizing the efficiency of the condenser. This portion of the invention is most beneficial at higher ambient temperature.

Taken together, both parts of the invention improve system performance and efficiency over the full range of operating conditions and temperatures.

Having described and illustrated the principles of the invention in a preferred embodiment thereof, is should be apparent that the invention can be modified slightly in arrangement and detail without departing from such principles. In that regard, this patent covers all modifications and variations falling within the spirit and scope of the following claims:

We claim:

1. Any refrigeration, air conditioning or process cooling system using a reciprocating screw, scroll, centrifugal or other similar type of compressor and any type of refrigerant, the improvement including a first positive-displacement pump used in a parallel piping arrangement which arrangement is parallel to a conventional conduit between a condenser and an expansion valve, and parallel with a differential pressure regulating valve and a check valve, and wherein the system includes a second pump in a liquid injection line between the output of the first pump and the output of a compressor, used for desuperheating the compressor discharge vapor, and a control mechanism that controls the speed of the second pump and thereby results in the desuperheating of the compressor discharge vapor to a saturated or near saturated condition at the inlet to the condenser, said control mechanism including a temperature sensor adapted to sense the temperature of the refrigerant at the condenser.

2. A system as recited in claim 1, wherein the system includes a control system which sets the minimum condensing temperature setting of refrigerant exiting the condenser to a lower-than-conventional value when the first pump is functioning properly and reverts the air conditioning or refrigeration system back to the higher minimum condensing temperature setting in case of failure of the first pump.

3. A vapor-compression heat transfer system having fluid refrigerant, a compressor, a condenser, an expansion valve, an evaporator, a refrigerant conduit between the condenser and the expansion valve, and a refrigerant pump in the conduit adapted to increase the pressure of the refrigerant between the condenser and the expansion valve, the improvement comprising (a) the fact that the said pump is a positive displacement pump, and (b) a first bypass conduit is provided in parallel around the pump, said first bypass conduit including a differential pressure regulating valve which imposes an upper limit on the pressure increase caused by the pump, and (c) a second bypass conduit is provided in parallel around the pump, said second bypass conduit including a check valve adapted to stop flow of refrigerant through the said second bypass conduit from the expansion valve to the condenser, but to allow flow of refrigerant through the said second bypass conduit from the condenser to the expansion valve, and (d) said pump, and bypass conduits being adapted to increase the said pressure of the refrigerant sufficiently to avoid the formation of refrigerant flash gas on the said conduit between the pump and the expansion valve, while still allowing flow of refrigerant from the condenser to the expansion valve if the pump fails to operate, wherein a liquid injector conduit is provided between an output side of the pump to an output side of the compressor, and adapted to deliver pressurized liquid refrigerant from the output of the pump to the output of the compressor to de-superheat the refrigerant which exists the compressor, and wherein the liquid injector conduit includes a variable-speed injector pump, and a control system is provided and adapted to monitor the difference in temperature of the refrigerant going into the condenser and within the condenser and to adjust the speed of the injector pump to minimize the difference in temperature, which in turn minimizes superheat in the refrigerant going into the condenser and, in turn, maximizes the efficiency of the condenser.

4. A compression type refrigeration system, comprising:

an evaporator, a compressor, a condenser, a refrigerant receiver and conduit means interconnecting the same in a single closed loop for circulating refrigerant therethrough, the conduit means including;

a first conduit for circulating a flow of refrigerant from the receiver to the evaporator and;

a second conduit for circulating a return flow of refrigerant gas from the evaporator to the receiver solely through the compressor and the condenser for condensation by the condenser at a first pressure directly related to the head pressure at the compressor;

a variable flow expansion valve in the first conduit adjacent the evaporator for expanding the flow of refrigerant into the evaporator;

a third conduit which provides a parallel path around a section of said first conduit adjacent an outlet port of the receiver;

a positive displacement pump in the third conduit adjacent the receiver, the pump being adapted, continuously during operation of the compressor, to increase the pressure of the condensed refrigerant in the first conduit by a generally constant increment of pressure of at least five pounds per square inch to provide the refrigerant with a second pressure greater than the first pressure by the amount of said increment, the second pressure being sufficient to suppress flash gas and feed a completely condensed liquid refrigerant to the expansion valve, the first conduit circulating the refrigerant solely through the pump;

motor means for the pump; and a magnetic pump drive connecting the motor means to the pump to drive the pump, and the system including a liquid injector conduit between the first conduit after said section, and a point in said second conduit between the compressor and the condenser, said liquid injector conduit including a variable speed pump, the speed of which is controlled by a first temperature sensor adapted to sense the temperature of the refrigerant in the condenser, and a second temperature sensor adapted to sense the temperature of the refrigerant going into the condenser, the speed of the variable speed pump being controlled by said temperature sensors so that just the proper amount of liquid refrigerant is injected into the second conduit at a point after the compressor to desuperheat the compressor discharge refrigerant for optimum heat transfer in the condenser regardless of the refrigerant flow rate through the condenser and regardless of the amount of superheat present in the compressor discharge refrigerant.

* * * * *